US005888060A

United States Patent [19]

Velke

[11] Patent Number: 5,888,060

[45] Date of Patent: Mar. 30, 1999

[54] METHOD AND DEVICE TO INCREASE COMBUSTION EFFICIENCY HEATING APPLIANCES

[76] Inventor: William H. Velke, P.O. Box 154 277 Campbellville Road, Campbellville, Ontario, Canada, LOP 1B0

[21] Appl. No.: 925,494

[22] Filed: Sep. 8, 1997

Related U.S. Application Data

[63] Continuation-in-part of Ser. No. 634,034, Apr. 17, 1996, abandoned.

[51] Int. Cl.[6] ..... F23D 11/44

[52] U.S. Cl. ..... 431/11; 431/2; 431/284; 431/278; 110/238

[58] Field of Search ..... 431/11, 284, 2, 431/161, 215, 216, 162, 278, 281; 110/238

[56] References Cited

U.S. PATENT DOCUMENTS

| | | | |
|---|---|---|---|
| 2,781,087 | 2/1957 | Storti et al. . | |
| 2,840,148 | 2/1958 | Akesson . | |
| 3,876,363 | 4/1975 | LaHaye et al. | 431/11 |
| 4,392,820 | 7/1983 | Niederholtmeyer | 431/284 |

*Primary Examiner*—Larry Jones

[57] ABSTRACT

A method to increase fluid hydrocarbon fluid BTU input for an appliance incorporating a combustion zone and a burner therein, and to increase fuel combustion intensity and thermal efficiency as well to reduce the appliance's harmful stack emissions, by employing a device which moderately pre-heats and conditions low temperature fuel delivered to the appliance prior to combustion, by extracting heat from the appliance's combustion zone in order to deliver fuel to the appliance's burner at a constant, pre-set operating temperature of between 37 degrees Fahrenheit and the fuel's flash point temperature.

21 Claims, 4 Drawing Sheets

METHOD AND DEVICE TO INCREASE COMBUSTION EFFICIENCY HEATING APPLIANCES

This application is a Continuation In Part Application and is related to the following prior applications:

Parent Application:

USA: No. 08/634,034, now abandoned

Filed: Apr. 17, 1996

Title: Method and device to increase combustion efficiency and to reduce harmful emission of heating appliances operating on fluid hydrocarbon fuels.

Applicant: W. H. Velke

INTERNATIONAL APPLICATION

PCT: No. PCT/CA 97/00015

Filed: 10 Jan. 1997

Title: Combustion method and device for fluid hydrocarbon fuels.

Applicant: W. H. Velke

FIELD OF THE INVENTION

The present invention relates to the improvement of the thermal efficiency of conventional fluid hydrocarbon fuels, such as natural gas and propane gas when employed as fuel for residential, commercial and industrial space heating, process heating and cooling appliances, whereby such thermal efficiency improvement is obtained through modifying the fuel's operating temperature prior to delivery of it to the combustion zone of such appliances.

BACKGROUND OF THE INVENTION

It is generally recognized that combustion ability of certain heavy waste oil employed as furnace fuel may be improved by significantly pre-heating, vaporizing or pre-mixing such fuel with vaporized gases or other vapors prior to combustion. It is also understood, that in many cases a heating appliance itself does not provide sufficient heat to effect such fuel vaporization or similar fuel conditioning treatment, and therefore additional means, such as electric heating coils and the like, have to be installed in order to facilitate such conditioning or pre-combustion treatment of heavy waste oil fuels.

It is further known that such high temperature pre-heating and vaporizing treatment is especially useful to effectively reduce viscosity of such heavy fuel in order to render it at all usable, and a number of prior art disclosures describe various complicated methods and devices specifically developed for that purpose.

In U.S. Pat. No. 3,876,363, La Haye et al. discloses a method, which uses an external source of heat as well as part of the combustion chamber heat, to finely atomize a hydrocarbon fluid such as fuel oil to produce an emulsion of the oil with a secondary fluid prior to fuel oil combustion, thereby increasing combustion efficiency and minimizing pollutant discharge during combustion of such emulsified fuel mixture. For this purpose, the fuel is pre-heated to a temperature of between 150 to 250 degrees Fahrenheit.

In U.S. Pat. No. 2,840,148, I. W. Akesson discloses a furnace burner-blower arrangement, which employs pressure and heat to pre-treat heavy fuel oil prior to combustion. The fuel oil is heated by way of a heating element which is controlled by thermostats to maintain a certain oil temperature range, but without stating any specific and most advantageous operating fuel oil temperature range.

In U.S. Pat. No. 2,781,087, Peter Storti et al. disclose a rotary cup type, heavy oil burner system, which circulates the fuel through the burner on its way to the atomizer nozzle. This application further utilizes an electric heating device to pre-heat the fuel oil in a thermostatically controlled oil reservoir prior to combustion. This system presents a distinct improvement over other prior art, in that it greatly reduces the fuel oil temperature fluctuations inherent in other fuel pre-heating systems. However, no specific fuel oil operating temperature range is indicated to claim combustion efficiency or emission reduction.

In CA Patent No. 380,126, Andrew Palko discloses an oil burner comprising an electric heating element to pre-heat the burner so as to cause instant vaporization of the fuel oil as it is fed to the burner. This system includes temperature control means to regulate the fuel oil temperature without specifying any particular fuel oil temperature or temperature range, which would be required to obtain the claimed vaporization and desired combustion efficiency or emission reduction. In CA Patent No. 457,123, Earl J. Senninger discloses an oil burner especially adapted for heavy oils. Such heavy fuel oils are pre-heated by way of an electric heating element prior to reaching the atomizing nozzle of the burner unit. Here the desired fuel oil operating temperature range is described as a temperature to be such as to insure against carbonizing of the fuel, which would normally be a temperature just short of combustion.

In U.S. Pat. No. 4,392,820, Niederholtmeier discloses a system for operating a heating appliance comprising the combination of unheated conventional fuel oil and pre-heated heavy waste oil in two separate pressure controlled distribution networks, precluding any intermingling of the two fuel sources. The waste oil is pre-heated to it's flash point level in order to reduce its viscosity and to render it combustible, and is fed to the burner after conditioning the burner by first operating it for a period of time with conventional untreated fuel oil, facilitating subsequent combustion of treated waste oil.

For the purpose of pre-combustion treatment of natural gas and propane gas, as well as other conventional hydrocarbon fuels for use in appliances incorporating a burner located in a combustion zone, so as to increase the thermal efficiency of such fuels in accordance with the present invention, a different set of circumstances is required.

In order to effect thermal energy and combustion efficiency, and a noticeable reduction in harmful flue gas emission, an appliance burner will respond to fuel delivered to its burner nozzle at a constant and specifically elevated pre-combustion temperature level. Such elevated temperature must not be as high as to approach the flash point temperature of the fuel or as to begin vaporizing the fuel prior to combustion, as this would interfere with the function of the burner nozzle, resulting in a loss of thermal efficiency, and as such would be contrary to the teaching in this disclosure. In fact, the most advantageous fuel pre-combustion operating temperature, according to the present invention, is a moderate temperature range somewhat above a normally low fuel delivery temperature experienced during the heating season, but sufficiently high to effect fuel expansion and effecting fuel BTU input of the normally low temperature delivered fuel without causing interference with the conventional combustion process of the appliance.

During more frigid periods of the year, when heating appliances are usually in operation, fuel stored in storage tanks especially, and fuel transported in conduits exposed to the elements for considerable distances, remains at a temperature well below the optimal contemplated operating range, and pre-heating fuel economically could provide a number of significant advantages available for both gas and oil applications. Even appliances operating during the summer period, such as gas fired cooling appliances or residential, commercial and industrial water and process heaters, may operate more efficiently with the contemplated fuel treatment method and device.

It is an established fact that some fluid hydrocarbon fuels may expand in volume by approximately 15% when heated from 35 degrees to 115 degrees Fahrenheit. Therefore, in a situation where such fuel is delivered to the burner mechanism at a low temperature, especially when reaching levels below 35 degrees Fahrenheit, fuel pre-heating would automatically result in a possible expansion of fuel volume of up to 15% and more.

Furthermore, such pre-heated fuel delivered to the burner nozzle at its more optimal operating temperature would produce significantly more intense and complete combustion, as the expansion of fuel allows for a better fuel to air/oxygen ratio mix, resulting in a measurable increase in burner efficiency as well as a measurable decrease in harmful flue gas emission. It is estimated that burner efficiency could improve by up to 10%, while harmful flue gas emission could be reduced by up to 35%.

It therefore stands to reason that a simple device, which could provide an economical method for a moderate pre-heating of combustion appliance fuel, such as natural gas, propane gas or other conventional fluid hydrocarbon appliance fuel prior to combustion, would be most desirable.

All prior art examined however seems to be specifically designed to treat only unconventional combustion fuels like heavy fuel oils or waste oils, and then at much higher temperatures, up to the flash point level or up to the vaporization level, rather than moderately pre-heating a conventional combustion fuels such as gas or No. 2 fuel oil, and in all cases, such prior art must rely without exception on additional heating elements to effect the relatively high temperature pre-heating process to the level of up to or above fuel vaporization or up to the flash point level of the fuel. This is of course contrary to the teaching disclosed in the present invention and outside the function of the method and device contemplated and described further herein, and there is no prior art available at all which teaches the pre-heat treatment of natural gas or propane gas for the purpose of increasing its thermal efficiency in accordance with this invention.

Furthermore, it is presently believed in the gas combustion appliance industry that pre-combustion treatment of fuel, as contemplated in this invention, is not affective to increase thermal efficiency. In fact, a correction formula is always employed in the industry to eliminate any variance in fuel efficiency calculations due to a change in fuel supply temperature. Such correction formula calculation may be found in the "Gas Engineers Handbook", Ninth Printing, Chapter 8, "Gas Calorimetry", Pages 6–42.

Therefore, the method and device as disclosed in the present invention is completely contrary to industry norm, and is not at all obvious or known in the art.

SUMMARY OF THE INVENTION

The present invention therefore discloses a method and device to moderately pre-heat natural gas or propane gas or other conventional fluid hydrocarbon fuels, as used in most of today's typical residential, commercial and industrial appliances incorporating a burner located in a combustion zone, which method and device is able to provide a certain amount of thermal energy fuel efficiency improvement, and at the same time reduce harmful flue gas emission when operating with the appliance.

Such method incorporates a device, which may be able to rely solely on heat generated by the appliance as the heat source for its fuel pre-heating operation, consisting of the following basic components.

It comprises a primary fuel supply conduit defining a heat exchanger assembly through which the fuel is routed on its way to the appliance's burner nozzle. This heat exchanger assembly is located in a heating zone which may employ heat from a heat source located either adjacent the appliance's combustion area, adjacent the appliance's flue gas vent area or adjacent the appliance's heat supply plenum area. Where access to any of such heat source locations is difficult, the heating zone may employ heat from a heat source unrelated to the appliance. The heat exchanger assembly may in certain applications incorporate a heat equalizer segment from heat storage material, as part of the heat exchanger assembly, in order to equalize heat transfer from the heating zone to the heat exchanger during the on/off cycles of the appliance. To prevent the fuel temperature from rising to a range anywhere near the fuels' flash point or vaporization level, a heat activated mixing valve may be incorporated in conjunction with a secondary fuel supply conduit bypassing the heating zone, which, in connection with a mixing means, may control delivery of fuel to the appliance's burner nozzle at a constant and pre-set desired optimal operating temperature range of between 90 and 135 degrees Fahrenheit, should the heating zone be subject to drastic temperature fluctuations. The contemplated general fuel operating temperature however must range somewhere between above 37 degrees Fahrenheit and below the fuel's flash point level or it's vaporization temperature, as the case may be. Instead of using a proposed mixing valve and fuel bypass conduit combination as a mixing means, it would be more desirous to achieve control of the desired fuel temperature range by designing the dimensions of the heat exchanger assembly and it's distance to the heat source such as to co-operate with the on and off operating cycle of the appliance, thereby maintaining a fuel temperature balance within a high and low temperature limit but close to the desired optimal temperature range. This is especially desirable for application to appliances located outside, like commercial rooftop furnaces and the like, where the heat exchanger may be situated in a heating zone adjacent the flue gas vent area of the appliance, and exposed to higher flue temperatures. The outside ambient temperature, which of course controls the operating mode and cycle of the appliance by way of the appliance's thermostat setting, would therefore also become a part of this fuel temperature balancing control mechanism.

The device operates according to the following method.

Fuel is routed from the incoming general fuel supply conduit through a primary fuel supply conduit defining a heat exchanger assembly, which is located in a heating zone, directly to the burner within the combustion zone of the appliance. Once the appliance is operational, heat is transferred to the heating zone, which may be located adjacent a heat source of the appliance such as the flue gas vent area or adjacent an alternate heat source area, pre-heating the fuel passing through the heat exchanger assembly located in the heating zone. In order to control the pre-selected fuel operating temperature, various means may be employed. The preferred means my rely on the dimensions of the heat exchanger assembly, its effect on fuel volume and flow velocity, it's distance in relation to the heat source operating the heating zone, and on the on and off cycle of the appliance. Another means may include a heat activated mixing valve located in a suitable housing, with such valve employed in conjunction with a secondary fuel bypass conduit, routed outside the heating zone, providing mixing means of unheated and heated fuel in proportions to maintain the desired fuel operating temperature range. Yet another means may employ a heat storage material as part of the heat exchanger assembly, surrounding at least in part the heat exchanger assembly, thereby assisting in the control of the desired fuel operating temperature level by equalizing heat transfer to the fuel during the on/off cycle of the appliance and the related high/low temperature exposure of the fuel as it is passing through the heat exchanger assembly. Yet a further means may employ a combination of means as heretofore described.

A similar effect may be achieved for applications to some appliances, from which heat for pre-heating may not be economically extractable, by employing a device which moderately pre-heats fuel by using a separate heat source other than a heat source related to the appliance's combustion zone or flue gas vent area, such as an electrical resistor element. Such heat source could then be adjusted to control the desired fuel temperature level.

The results obtained during tests conducted with liquid propane gas and natural gas, supplied at a range of temperatures to a typical residential combustion furnace mechanism, demonstrate quite readily the advantages of the contemplated method and device.

If the average winter temperature of stored propane gas, or the temperature of natural gas transported underground, is 36.7 degrees Fahrenheit, a pre-combustion increase of fuel temperature to 110 degrees Fahrenheit would produce following efficiency improvements for propane gas:

a) The BTU input value increases by 15.50%. This is due to the volume of fuel expanding, (reduction in fuel density).

b) The amount of CO2% increases by 77.73%, with the flue temperature increasing by 10.00%. This indicates the occurrence of a more efficient and intense combustion. Such 10% flue temperature increase represents approximately 50 Degrees Fahrenheit above normal flue temperature.

c) Steady State Degrees increase by 9.14%, which, together with the BTU input increase, indicates a 24.64% increase in total energy efficiency.

d) The Net Energy Loss is reduced by 5.19%, which increases the spread between Net Energy Loss Reduction and Allowable Loss to 17.97%, which is interpreted as a significant reduction of Energy Loss.

For natural gas under the same test conditions similar results were obtained, indicating following significant energy efficiency improvements.

a) The BTU input value increases by 12.56%. This is due to the volume of fuel expanding, (reduction in fuel density).

b) The amount of CO2% increases by 59.56%, with the flue temperature increasing by 8.47%. This indicates the occurrence of a more efficient and intense combustion. Such 8.47% flue temperature increase represents approximately 40 Degrees Fahrenheit above normal flue temperature.

c) Steady State Degrees increase by 8.43%, which together with the BTU input increase, indicates a 20.99% increase in total energy efficiency.

d) The Net Energy Loss is reduced by 5.53%, which increases the spread between Net Energy Loss Reduction and Allowable Loss to 15.92%.

When the increased flue temperature Degrees, as experienced during the tests, are converted into usable energy by suitably converting and adjusting appliance burner orifice size and possibly the heater box or heat exchanger configuration, an additional 8% to 10% of energy efficiency improvement may conservatively be achieved, for a total energy efficiency improvement in excess of 25%.

Indications are, that conventional light fuel oil, like a No. 2 heating oil, pre-treated under the same test conditions will experience even more significant energy efficiency improvements because of its higher density.

For a better understanding of the present invention and how the disclosed device in accordance with the before described method of operation will result in the herein detailed fuel efficiency improvement and emission reduction, reference should be had to the drawings and descriptive matter in which there are illustrated and described the preferred embodiments of the invention. However, while only a few embodiments of the invention have been illustrated and described, it is not intended to be limited thereby but only by the scope of the appended claims.

DETAILED DESCRIPTION OF A PREFERRED EMBODIMENT

Figure 1:
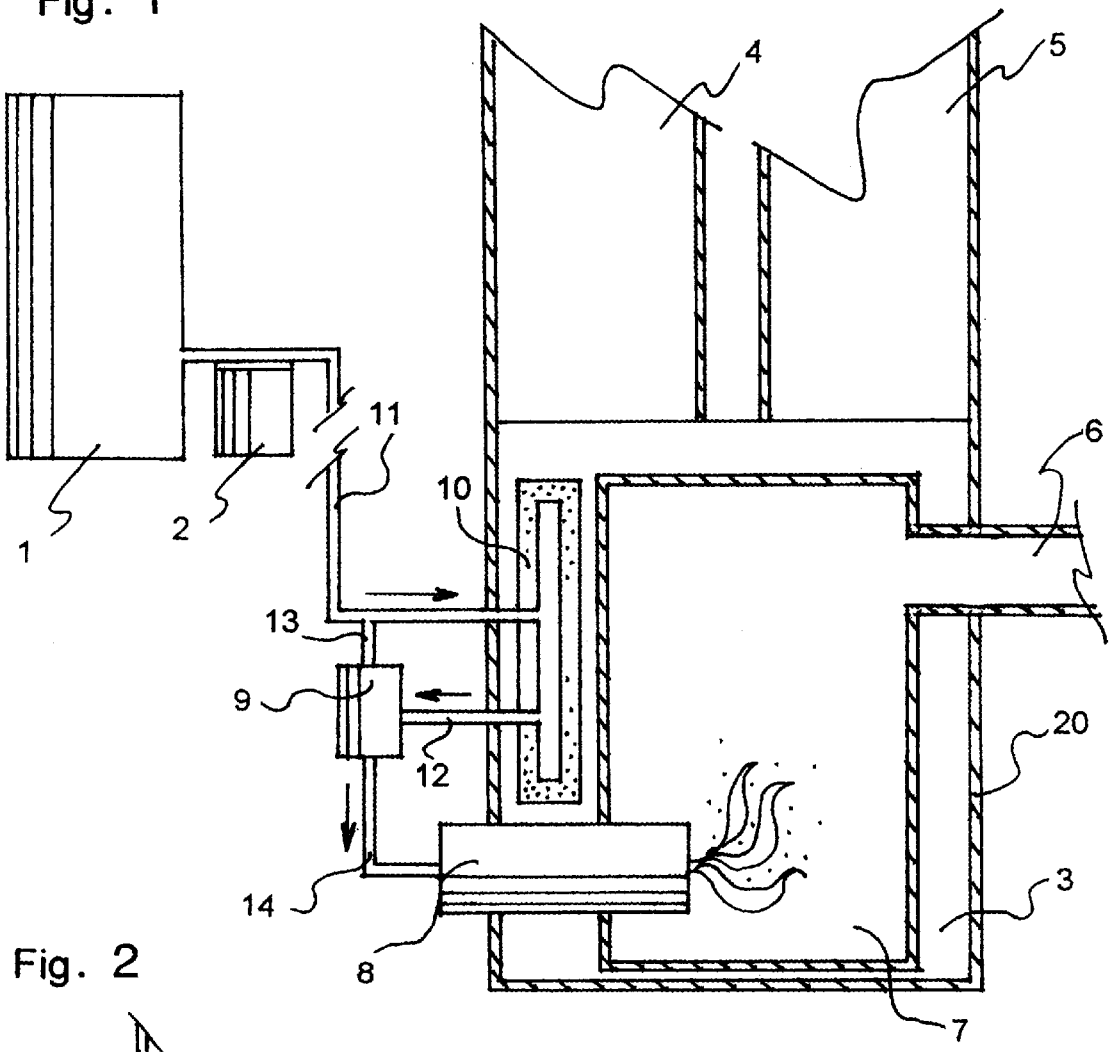
FIG. 1 of the drawings appended hereto depicts a view of a typical heating appliance in side elevation with a heat exchanger assembly located within its heating zone housing extending through a heating zone adjacent the combustion zone of the appliance, illustrating the general method of operation of the invention.

Referring now to FIG. 1 of the drawings, there is shown, in side elevation view, the operating method in a general layout of a fuel pre-heating system, consisting of a fuel oil or propane gas tank 1, which is usually located remote from the heating appliance's location. The fuel conduit, on its way from the tank to the appliance burner, leads, in case of fuel oil, through fuel filter 2. Fuel conduit 11 may then be connected to the fuel supply from the remote tank location or, in the case of natural gas, directly to the main fuel supply conduit and meter. Such primary fuel supply conduit 11 leads to the heat exchanger assembly inside a heating zone housing 10, which extends through a heating zone, from where fuel delivery is connected through fuel conduit 12 via fuel conduit 14 to the burner 8. When desirable, and as shown in this illustration, fuel conduit 12 may first lead to a mixing valve 9, which operates in conjunction with a secondary fuel by-pass conduit 13, which avoids the heat exchanger assembly inside heating zone housing 10, leading from conduit 11 to mixing valve 9, where it makes untreated fuel available on demand for mixing with temperature elevated fuel supplied from the heat exchanger assembly. In this case, fuel conduit 14 connects mixing valve 9 with the appliance burner 8, located in the combustion zone 7, which in turn is generally located inside the appliance 3. The heating appliance 3 is further attached to the supply air duct 4 and to return air duct 5 and to the appliance flue gas vent 6, which is connected to the appliance's chimney or mechanical exhaust.

The method of operation of a typical appliance fuel pre-heating system is as follows:

From the general fuel supply conduit or from the appliance's fuel tank connection, fuel is routed via a primary fuel conduit to the heat exchanger assembly with its heating zone housing extending through a heating zone, wherein the fuel is heated by way of heat extraction from the appliance or other suitable heat source. The heating zone may be located adjacent the combustion zone, or may be located adjacent the flue vent area or the hot air supply area of the appliance. In some cases, where such arrangement is impossible, the heating zone may employ a heat source unrelated to the appliance. The such heated fuel is then routed from the heating zone housing outlet either to a mixing means, where it is mixed, by way of a secondary fuel supply conduit, delivering untreated, lower temperature fuel to adjust the fuel temperature according to the set operating range, or, if the fuel temperature automatically remains within the desired fuel operating temperature range, is routed without employing mixing means directly from the heating zone housing outlet to the burner in the appliance's combustion zone, where fuel combustion is effected. All other appliance components will operate as commonly understood in the art, except for the fact that combustion efficiency will now be increased and harmful flue gas emission will be reduced.

Figure 2:
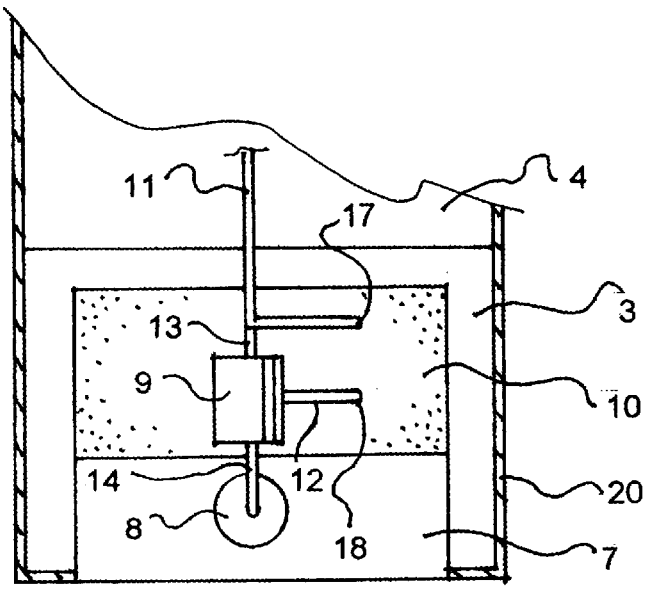
FIG. 2 of the drawings appended hereto depicts a view of a typical heating appliance as shown in FIG. 1, but in front elevation, with a heat exchanger assembly located within its heating zone housing extending through a heating zone located adjacent the combustion zone of the appliance.

In FIG. 2 of the drawings, there is shown again, this time in front elevation view, the operating method in a general layout of a fuel pre-heating system as shown in FIG. 1, with the location of the heat exchanger assembly in heating zone housing 10 relative to the heating appliance 3 and specifically to the appliance's combustion zone 7. It also shows the location of the fuel mixing valve 9, which may be employed in some applications, and its connection to appliance burner 8. The heat exchanger assembly, in order to absorb heat efficiently from the appliance, has its heating zone housing extended through a heating zone located either within or above the appliance's shroud 20, or directly adjacent the surface of the appliance's combustion zone 7. In case of a typical residential furnace application, the heating zone may be located either at the front panel of the combustion zone, as shown in this illustration, or either against a side panel or above the top panel of the combustion zone, inside the hot air plenum 4, depending on the appliance's make or model, or depending on the type of after market installation. The heat exchanger assembly in its heating zone housing 10 is connected at its inlet location 17 to primary fuel supply conduit 11 leading from the remote fuel tank or general fuel supply conduit, while fuel conduit 12 is connected at the heating zone housing outlet location 18, and leads from the heat exchanger assembly either directly to the burner 8, or as shown in this case as the alternate operating method, to the heat activated fuel mixing valve 9. Such mixing valve is then further connected to a secondary fuel supply conduit 13, which by-passes the heating zone, leading directly from the remote fuel tank or primary fuel supply conduit 11, to provide untreated fuel for mixing, and fuel conduit 14 finally directs heat treated fuel at the pre-set temperature to the appliance burner 8. In order to maintain fuel delivery at a constant temperature level, fuel conduit 12, leading from the heat exchanger assembly in the heating zone housing to mixing valve 9, as well as fuel conduit 14, leading from mixing valve 9 to the appliance's burner 8, and of course the mixing valve itself, should be suitably insulated against external heat loss. For the same reason, valve 9 should be located at as close a distance as possible to the appliance burner location 8.

Figure 3:
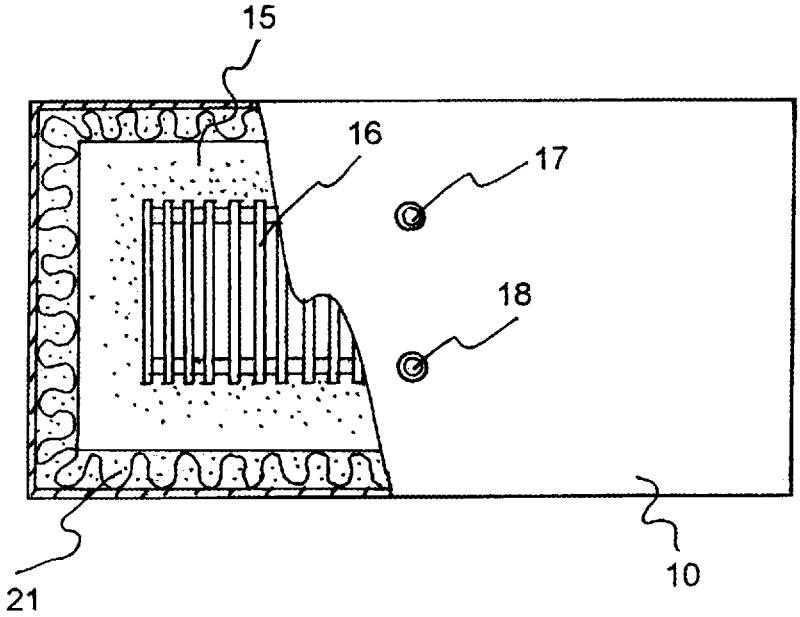
FIG. 3 of the drawings appended hereto depicts a partial cut-away view, in front elevation, through a heating zone housing with its heat exchanger assembly, including a heat equalizer segment, to fit a typical appliance combustion zone application.

In FIG. 3 of the drawings is shown a partial cut-away view through a heat exchanger assembly in its heating zone housing 10, in front elevation view, consisting of a heat equalizer segment 15 which absorbs heat from the appliance, and as such is constructed from a material with heat storage capacity like ceramic or the like. This heat equalizer segment surrounds the heat exchanger 16, which is in this case a hollow plate heat exchanger, designed especially to transfer heat efficiently from the heat equalizer portion to the fuel as it passes through such heat exchanger. The heat exchanger is connected to the fuel supply from the fuel tank or general fuel supply conduit via the primary fuel supply conduit at heating zone housing inlet 17 from where untreated fuel enters the heat exchanger assembly, and, after being heated in the heat exchanger, such fuel exits at heating zone housing outlet location 18 to the appropriate fuel conduit for delivery either to the mixing valve or directly to the appliance burner. The heat exchanger assembly has all its surface areas, which are subject to external heat loss, protected through insulation material 21.

Figure 4:
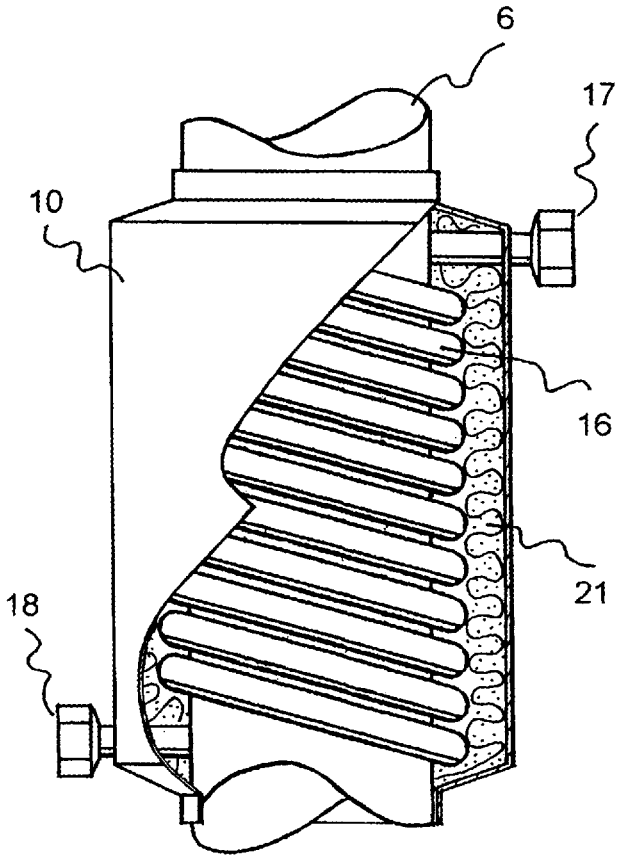
FIG. 4 of the drawings appended hereto depicts a partial cut-away view, in front elevation, of a heating zone housing with a heat exchanger assembly, to fit a typical appliance flue vent application.

In FIG. 4 of the drawings is shown a partial cut-away view through a heat exchanger assembly in its heating zone housing 10, in front elevation view, designed especially to fit flue vent applications for appliances such as water heaters, suspended commercial space heaters and other appliances with a typical flue vent configuration 6 and flue gas temperatures in excess of 280 degrees Fahrenheit. The heat exchanger 16, which is designed to transfer heat to the fuel as it passes through it, is in this case constructed from a typical fuel supply conduit such as a steel flex connector for gas, or a copper tube conduit for other fluid hydrocarbon fuel applications. The heat exchanger is connected to the fuel supply from the fuel tank or general fuel supply conduit via the primary fuel supply conduit at heating zone housing inlet 17 from where untreated fuel enters the heat exchanger assembly, and, after being heated in the heat exchanger, such fuel exits at heating zone housing outlet location 18 to the appropriate fuel conduit for delivery either to the mixing valve or directly to the appliance burner. The heat exchanger assembly is protected against external heat loss through insulation material 21.

Figure 5:
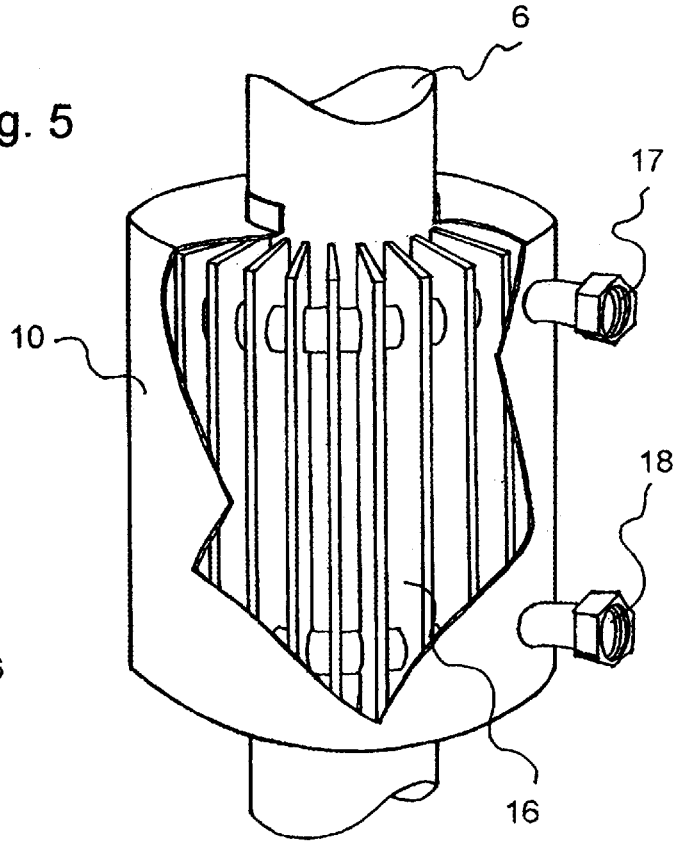
FIG. 5 of the drawings appended hereto depicts a partial cut-away isometric view of a heating zone housing with a variation of a heat exchanger assembly, to fit a typical appliance flue vent application.

In FIG. 5 of the drawings is shown a partial cut-away isometric view through a heat exchanger assembly in its heating zone housing 10, in front elevation, designed especially to fit flue vent applications for appliances such as water heaters, suspended commercial space heaters and other appliances with a typical flue vent configuration 6 and flue gas temperatures in excess of 280 degrees Fahrenheit. The heat exchanger 16, which is designed to transfer heat efficiently to the fuel as it passes through it, is in this case constructed from hollow plates, which allows maximum exposure of fuel surface to the heat source. The heat exchanger is connected to the fuel supply from the fuel tank or general fuel supply conduit via the primary fuel supply conduit at heating zone housing inlet 17 from where untreated fuel enters the heat exchanger assembly, and, after being heated in the heat exchanger, such fuel exits at heating zone housing outlet location 18 to the appropriate fuel conduit for delivery either to the mixing valve or directly to the appliance burner. The heat exchanger assembly may or may not include insulation material to reduce external heat loss.

Figure 6:
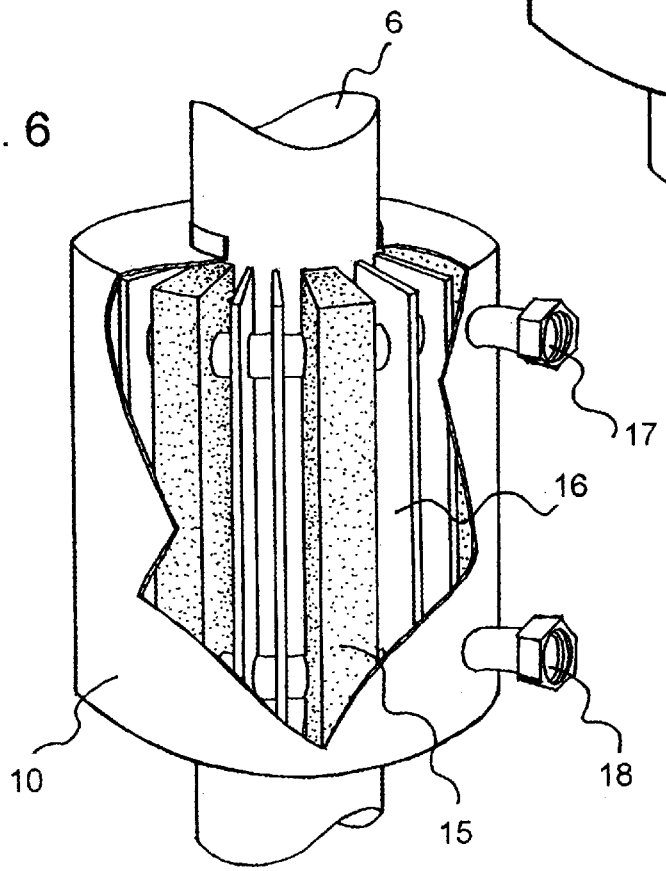
FIG. 6 of the drawings appended hereto depicts another partial cut-away isometric view of a heating zone housing with yet a further variation of a heat exchanger assembly including heat equalizer segments, to fit a typical appliance flue vent application.

In FIG. 6 of the drawings is shown a partial cut-away isometric view through a heat exchanger assembly in its heating zone housing 10, as shown in FIG. 5, designed especially to fit flue vent applications. This time, the hollow plate heat exchanger 16 is interspersed with heat equalizer segments 15, which absorb heat to balance heat transfer to the fuel during the appliances on/off operating cycles. The heat exchanger is again connected to the fuel supply from the fuel tank or general fuel supply conduit via the primary fuel supply conduit at heating zone housing inlet 17 from where untreated fuel enters the heat exchanger assembly, and, after being heated in the heat exchanger, such fuel exits at heating zone housing outlet location 18 to the appropriate fuel conduit for delivery either to the mixing valve or directly to the appliance burner. The heat exchanger assembly may or may not include insulation material to reduce external heat loss.

Figure 7:
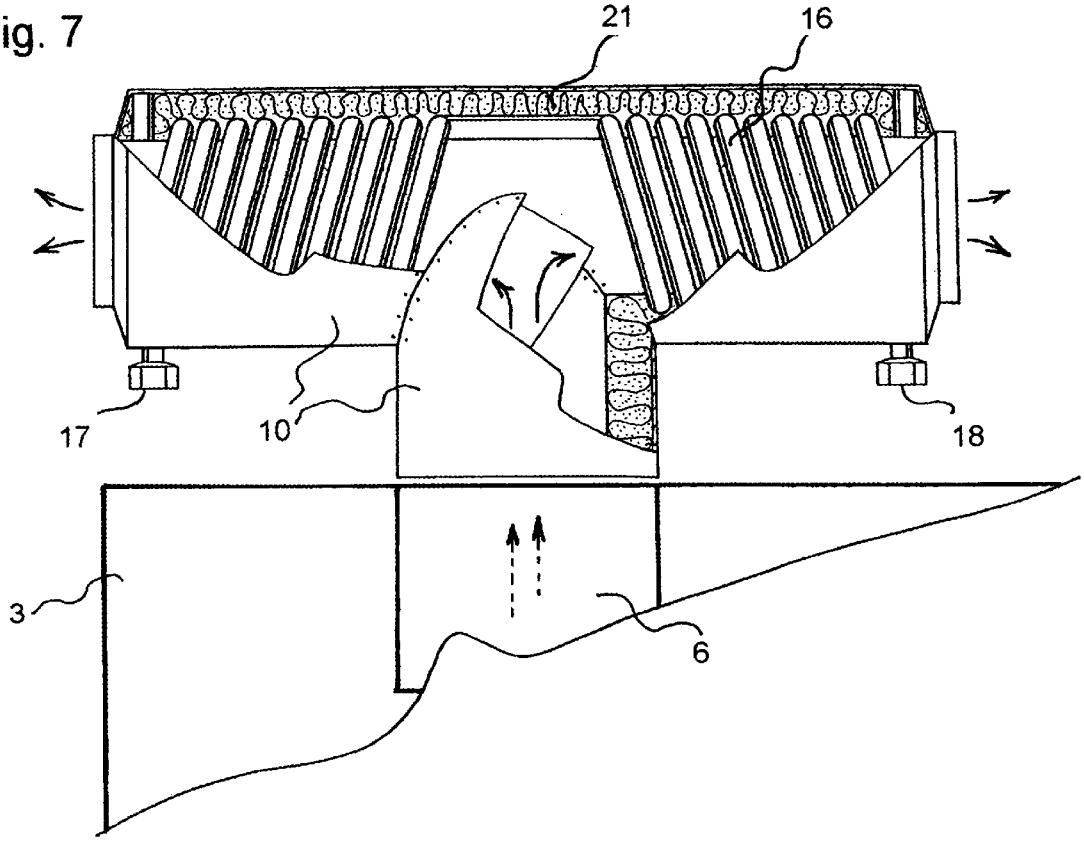
FIG. 7 of the drawings appended hereto depicts yet another partial cut-away view of a heating zone housing with a heat exchanger assembly, to fit a typical commercial rooftop appliance flue vent application.

In FIG. 7 of the drawings is shown a partial cut-away view through a heat exchanger assembly in its heating zone housing 10, in front elevation view, similar as in FIG. 4, this time designed especially to fit flue vent applications for appliances such as commercial, roof mounted space heaters and cooling equipment, with a typical flue vent configuration as indicated in 6, and flue gas temperatures in excess of 280 degrees Fahrenheit. The heat exchanger 16, which is designed to transfer heat to the fuel as it passes through it, is here again constructed from a typical fuel supply conduit such as a steel flex connector for gas, or a copper tube conduit for other fluid hydrocarbon fuel applications. The heat exchanger is connected to the fuel supply from the fuel tank or general fuel supply conduit via the primary fuel supply conduit at heating zone housing inlet 17 from where untreated fuel enters the heat exchanger assembly, and, after being heated in the heat exchanger, such fuel exits at heating zone housing outlet location 18 to the appropriate fuel conduit for delivery either to the mixing valve or directly to the appliance burner. The heat exchanger assembly is protected against external heat loss through insulation material 21.

Figure 8:
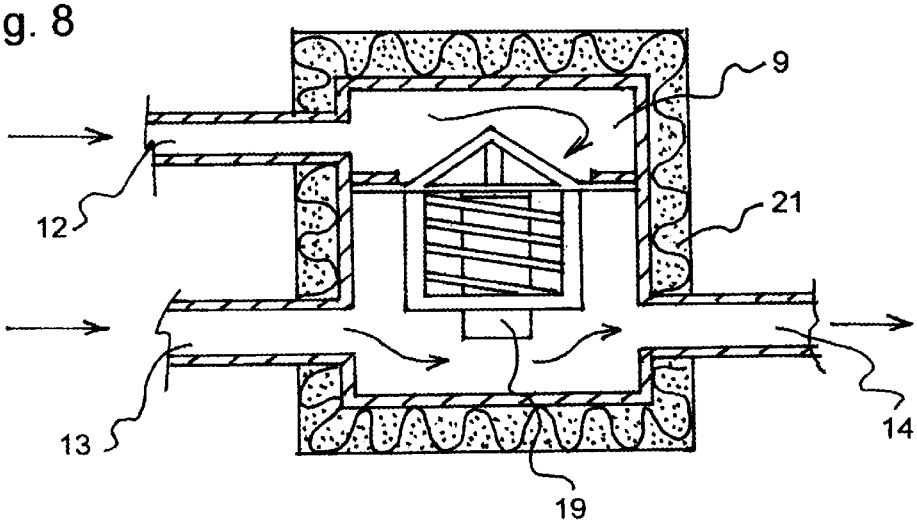
FIG. 8 of the drawings appended hereto depicts a sectional view through a typical three port heat activated mixing valve in its insulated housing.

In FIG. 8 of the drawings is illustrated a heat activated fuel mixing valve 9 in sectional view, showing its insulation cover 21, insulated fuel line 12 from the heat exchanger/fuel storage radiator, fuel line 13 from the remote heating appliance fuel tank or supply line, and insulated fuel line 14 leading to the appliance's burner. The arrows indicate the flow direction and mixing of the fuel flow, and how the heat activated valve 19 may respond to a preset temperature variance and thereby facilitating a mixing action of heated and unheated fuel to reach the desired temperature for delivery to the appliance's burner nozzle. The thermally activated valve actuator 19 may be a known in the art wax element actuator with creep action response, or the like, as shown here, pre-set to operate at a particular temperature or temperature range, or may be a temperature selective valve actuator operated by a remote sensor, controlled by a variable temperature thermostat.

A device according to the present invention may be manufactured using established manufacturing techniques and components known in the art, and such device may then be attached to a heating appliance natural gas or propane gas or other conventional fluid hydrocarbon fuels, and may be operated in accordance with the method as disclosed herein.

I claim:

1. A method of increasing the thermal efficiency of natural gas or propane gas, employed as conventional fluid hydro carbon fuel for an appliance having a combustion zone and a burner therein, which method results in a reduction of consumption of conventional fuel by said appliance without reducing appliance output, comprising:

a) providing natural gas or propane gas as fuel for said appliance;

b) directing said fuel through a primary fuel supply conduit defining a heat exchanger assembly that extends through a heating zone having an inlet and an outlet;

c) heating the fuel as it flows through said heat exchanger assembly to an optimal fuel operating temperature level ranging between 90 and 135 degrees Fahrenheit;

d) maintaining a continuous supply of fuel to said burner in the combustion zone of said appliance.

2. A method according to claim 1, wherein the optimal fuel temperature level is constantly maintained by:

a) directing a portion of said fuel through a secondary fuel supply conduit bypassing the heating zone, and, b) mixing heated fuel from the heat exchanger assembly with unheated fuel from the secondary fuel supply conduit in a mixing means;

c) adjusting the ratio of heated to unheated fuel within the mixing means to constantly maintain the temperature of the resultant mixture at said preselected optimal operating temperature rang.

3. A method according to claim 1, wherein the heat transfer to the fuel is stabilized with a heat storage material forming part of the heat exchanger assembly.

4. A method according to claim 1, wherein said heating zone is located adjacent the combustion zone of the appliance.

5. A method according to claim 1, wherein said heating zone is located adjacent a heat source other than the combustion zone of the appliance.

6. A method according to claim 1, wherein said preselected optimal fuel operating temperature range is within the preselected general fuel operating temperature range from above 37 degrees Fahrenheit to below the flash point level of said fuel.

7. A method according to claim 1, wherein the appliance is a space heater.

8. A method according to claim 1, wherein the appliance is a water heater.

9. A method according to claim 1, wherein the appliance is a process heater.

10. A method according to claim 1, wherein said fuel for the operation of the appliance is conventional fluid hydro carbon fuel other than natural gas or propane gas.

11. A device for increasing the thermal efficiency of natural gas or propane gas when used as conventional hydrocarbon fuel in an appliance having a combustion zone with a burner located therein, which device results in a reduction of consumption of conventional fuel by said appliance without reducing appliance output, comprising:

a) a housing means defining a heating zone;

b) a fuel supply conduit defining a heat exchanger assembly extending through said heating zone, providing the primary conveyance of fuel to the appliance, having a fuel inlet and a fuel outlet;

c) means to maintain a continuous supply of fuel to the burner in the combustion zone of said appliance at a preselected optimal operating temperature level ranging between 90 and 135 degrees Fahrenheit.

12. A device according to claim 11, wherein said means to maintain a continuous supply of fuel at a preselected optimal temperature range, comprises:

a) a secondary fuel supply conduit to allow a portion of fuel supply to bypass the heating zone for mixing of unheated fuel with heated fuel from the heat exchanger assembly in a mixing means;

b) a mixing means to adjust the ratio of heated to unheated fuel to constantly maintain the temperature of the fuel mixture at said preselected optimal temperature range;

c) a sensing means responsive to the fuel temperature, operational to control the ratio of fuel mixture in said mixing means.

13. A device according to claim 11, wherein a heat storage material forming part of said heat exchanger assembly balances the temperature fluctuations occurring in the heating zone.

14. A device according to claim 11, wherein said heating zone is located adjacent the combustion zone of the appliance.

15. A device according to claim 11, wherein said heating zone is located adjacent a heat source other than the combustion zone of the appliance.

16. A device according to claim 11, wherein said means to maintain a continuous supply of fuel to the burner in the combustion zone of the appliance at said optimal fuel temperature range operates within a preselected general fuel operating temperature range from above 37 degrees Fahrenheit to below the flashpoint level of said fuel.

17. A device according to claim 11, wherein the fuel conduit conveying heated fuel to the burner in the combustion zone of an appliance is covered with insulating material to reduce heat loss.

18. A device according to claim 11, wherein the appliance is a space heater.

19. A device according to claim 11, wherein the appliance is a water heater.

20. A device according to claim 11, wherein the appliance is a process heater.

21. A device according to claim 11, wherein the conventional fluid hydrocarbon fuel used in the appliance is other than natural gas or propane gas.

* * * * *

UNITED STATES PATENT AND TRADEMARK OFFICE

CERTIFICATE OF CORRECTION

PATENT NO. : 5,888,060
DATED : March 30, 1999
INVENTOR(S) : William H. Velke

It is certified that error appears in the above-identified patent and that said Letters Patent is hereby corrected as shown below:

Title page, Item [54] and Column 1, line 1,
Change title from "METHOD AND DEVICE TO INCREASE COMBUSTION EFFICIENCY HEATING APPLIANCES" to -- COMBUSTION METHOD AND DEVICE FOR FLUID HYDROCARBON FUELS --

Column 10,
Line 28, change "90 to 135 degrees fahrenheit" to -- above 37 degrees fahrenheit to below the flash point level of said fuel --
Line 54, change "above 37 degrees fahrenheit to below the flash point level of said fuel" to -- 90 to 135 degrees fahrenheit --

Column 11,
Line 12, change "90 to 135 degrees fahrenheit" to -- above 37 degrees fahrenheit to below the flash point level of said fuel --

Column 12,
Line 8, change "above 37 degrees fahrenheit to below the flash point level of said fuel" to -- 90 to 135 degrees fahrenheit --

Signed and Sealed this

Twenty-fourth Day of August, 2004

JON W. DUDAS
*Director of the United States Patent and Trademark Office*